US005239124A

United States Patent [19]

Eitaki et al.

[11] Patent Number: 5,239,124

[45] Date of Patent: Aug. 24, 1993

[54] ITERATION CONTROL SYSTEM FOR AN AUTOMATIC PLAYING APPARATUS

[75] Inventors: Shoe Eitaki, Hamakita; Tsutomu Saito, Shizuoka, both of Japan

[73] Assignee: Kabushiki Kaisha Kawai Gakki Seisakusho, Japan

[21] Appl. No.: 678,531

[22] Filed: Mar. 28, 1991

[30] Foreign Application Priority Data

Apr. 2, 1990 [JP] Japan ..... 2-84971

[51] Int. Cl.[5] ..... G10H 1/36

[52] U.S. Cl. ..... 84/634; 84/477 R

[58] Field of Search ..... 84/602, 604, 609, 610, 84/634, 649, 650, 666, 612, 615, 644, 601, 613, 614, 637, 641, 642, DIG. 29, 477 R, 478

[56] References Cited

U.S. PATENT DOCUMENTS

| | | | |
|---|---|---|---|
| Re. 33,607 | 6/1991 | Yuzawa et al. | 84/609 |
| 4,454,797 | 6/1984 | Amano | 84/609 |
| 4,708,046 | 11/1989 | Kozuki | 84/609 |
| 4,972,753 | 11/1990 | Adachi et al. | 84/609 |
| 5,003,860 | 4/1991 | Minamitaka | 84/609 |
| 5,092,216 | 3/1992 | Wadhams | 84/602 |

*Primary Examiner*—Stanley J. Witkowski
*Assistant Examiner*—H. Kim
*Attorney, Agent, or Firm*—Bruce L. Adams; Van C. Wilks

[57] ABSTRACT

An automatic playing device' including a memory which stores sequence data consisting of musical sound data and sequence data to control read-out of the musical sound data. A processing unit repeatedly reads out musical sound data specified by the control data included in the sequence data stored in this memory. A movement instruction switch gives instructions for movement of an accompaniment part to be played. A control device which, when an instruction for movement of a part to be played is issued by the movement instruction switch, terminates the operation to repeatedly read out musical sound data if musical sound data stored in the memory is being repeatedly read out by the processing unit. In which case, the control device moves system operation to an operation to read out the next sequence data. For example, automatic accompaniment is made by sequentially reading out sequence data stored in the memory, and for instance, accompaniment to improvisation is realized by repeatedly reading out a portion specified by the control data stored in the memory. Thus, if the player wishes to go out of the improvisation part and gives an instruction for movement of an accompaniment part to be played with the movement instruction switch, system operation goes to an operation to read out the next sequence data.

10 Claims, 6 Drawing Sheets

Fig. 2A

| ADDRESS | CONTENTS (KEY DATA) | |
|---|---|---|
| n + 0 | 0 | KEY CODE |
| n + 1 | STEP TIME | |
| n + 2 | 0 | VELOCITY |
| n + 3 | GATE TIME | |

Fig. 2B

| ADDRESS | CONTENTS (TONE DATA) | |
|---|---|---|
| n + 0 | 1 | TONE CODE |
| n + 1 | STEP TIME | |

Fig. 2C

| ADDRESS | CONTENTS (BAR DATA) | |
|---|---|---|
| n + 0 | ALL "1" | |
| n + 1 | 00 | — |

Fig. 2D

| ADDRESS | CONTENTS (REPEAT START DATA) | |
|---|---|---|
| n + 0 | ALL "1" | |
| n + 1 | 01 | REPEAT NUMBER |

Fig. 2E

| ADDRESS | CONTENTS (REPEAT END DATA) | |
|---|---|---|
| n + 0 | ALL "1" | |
| n + 1 | 10 | — |

Fig. 2F

| ADDRESS | CONTENTS (COMPLETE END DATA) |
|---|---|
| n + 0 | ALL "1" |
| n + 1 | ALL "1" |

Fig. 3

| | |
|---|---|
| RSA SEGISTER | REPEAT START ADDRESS |
| RN SEGISTER | REPEAT NUMBER |
| PA SEGISTER | PLAY ADDRESS |
| BN SEGISTER | BAR NUMBER |

Fig. 4A (ii)
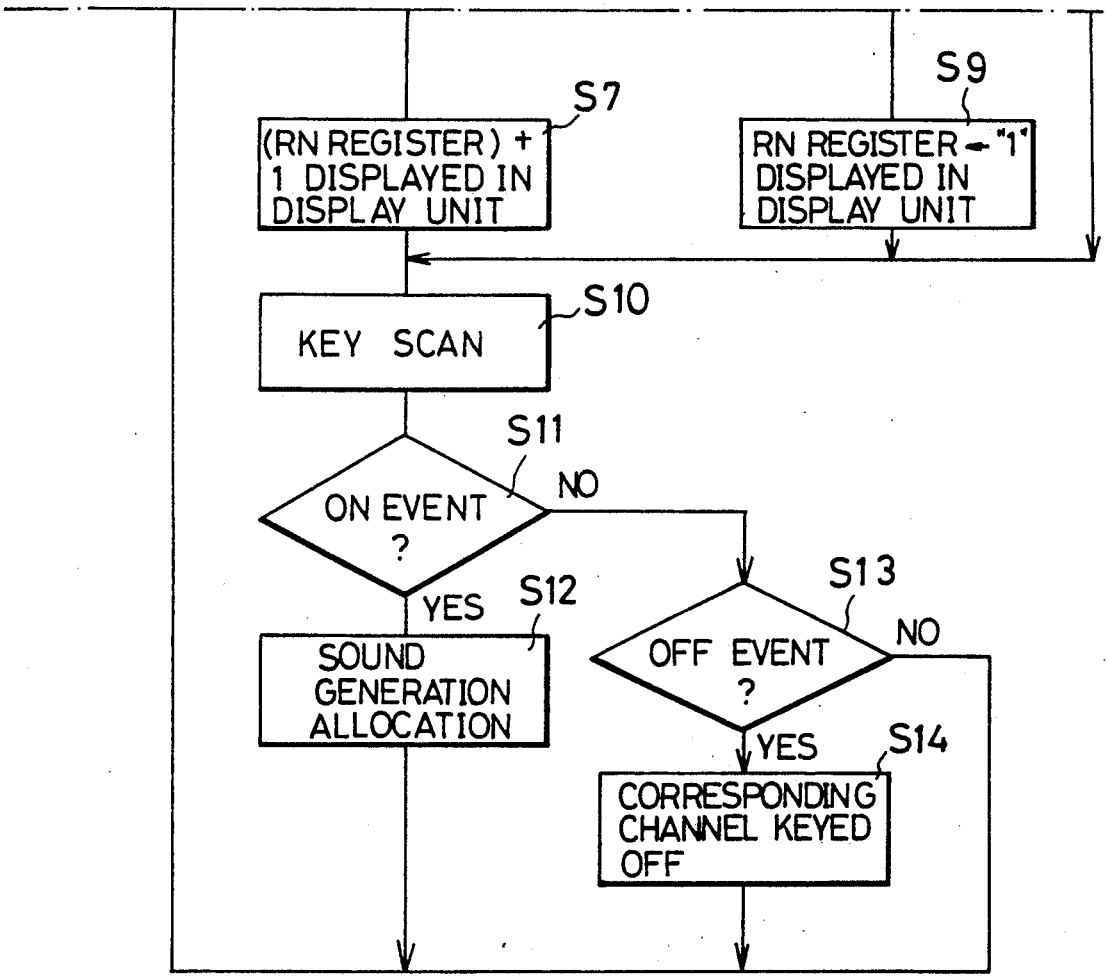

| Fig.4B (i) | Fig.4B (ii) |
|---|---|

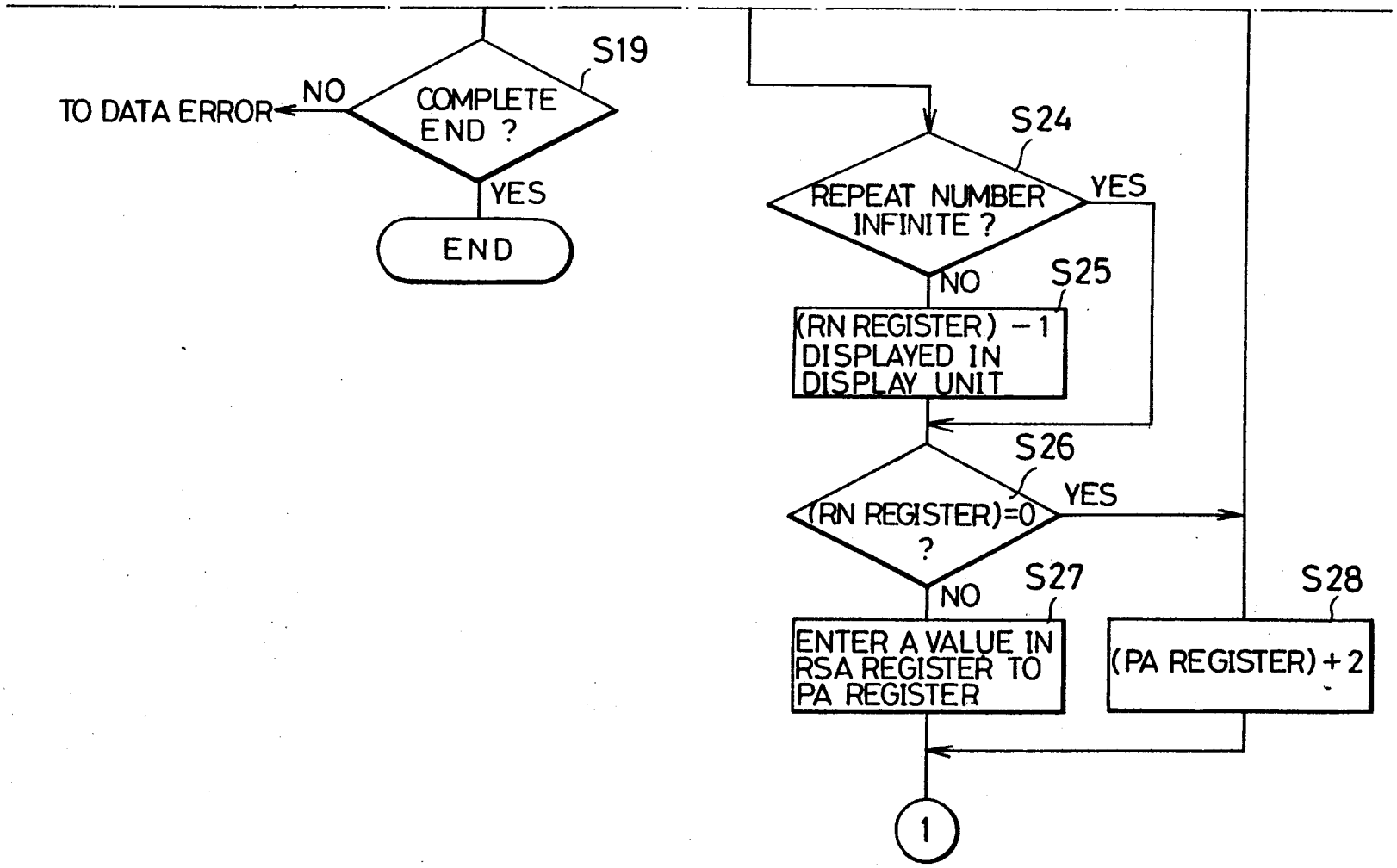
Fig. 4B (ii)

ITERATION CONTROL SYSTEM FOR AN AUTOMATIC PLAYING APPARATUS

BACKGROUND OF THE INVENTION

1. Field of the invention

This invention relates to an automatic playing device having a function to automatically perform accompaniment. More particularly, the invention relates to an automatic playing device for use when a player improvises with an automatic accompaniment which is effective to increase freedom of the improvisation.

2. Description of the Related Art

An automatic playing device which can automatically perform code accompaniment, namely an automatic playing device having a function for automatic accompaniment is well known.

The automatic playing devices as described above include those which store all data of a tune from its head to its end, for example recording using a sequencer. The sequencer accompanies the tune continuously from its head to the end by sequentially reading out the stored data other prior art store a certain length of rhythm patterns and code patterns and continue accompaniment by repeating an operation to sequentially read out the stored data (rhythm patterns and code patterns). These devices restart reading out from the beginning after reading out the aforesaid certain length of data.

Of the conventional types of automatic playing devices as described above, when playing a musical instrument accompanied by the latter type of automatic playing device, the player gives an instruction of a number of repetition to the automatic playing device. The device performs accompaniment according to the instruction. For this reason, in a tune which contains a plurality of improvisational parts based on repetition of a certain zone, a player must remember many numbers of repetitions, which makes it difficult for the player to concentrate on improvisation, and results in a musical performance is remarkably deteriorated.

Also, there is a defect in that, where a number of repetitions is not fixed, for example, adlib in jazz music, a length of improvisation can not be flexibly changed from time to time according to a player's mood.

SUMMARY OF THE INVENTION

An object of this invention is to overcome the defects of conventional automatic playing devices as described above. Another object of this invention is to provide an automatic playing device which has excellent operability to insure high musical quality of a performance accompanied by an automatic playing device. To accomplish these objects, the present invention provides a device in which a player does not have to remember numbers the of repetitions of each automatic accompaniment and can part and can concentrate on improvisation freely enjoy improvisation with an arbitrary length of time.

An automatic playing device according to this invention is characterized in that, in order to achieve the above objectives, said automatic playing device is equipped with a memory to store sequence data comprising musical sound data and control data used to control an operation to read out said musical sound data. A processing unit repeatedly reads out musical sound data and generates sound, which becomes the automatic accompaniment part of the musical performance, according to control data included in sequence data stored in the memory. A movement instruction switch gives instructions on movement of the automatic accompaniment parts to be played. A control device which, when an instruction on movement of a part to be played is issued by the movement instruction switch, determines if musical data stored in the memory is being repeatedly read out by the processing unit, terminates the operation to repeatedly read out musical sound data and starts an operation to read out the next sequence data.

In this invention, for instance, an automatic accompaniment is carried out by sequentially reading out sequence data stored in the memory. A accompaniment in, for instance, an improvisational part arranged during the automatic accompaniment is realized by repeatedly reading out specified sections according to control data in the aforesaid memory. When a player desires to improvise, the player can select to read out of the next sequence data by giving an instruction on movement of a part to be played with the movement instruction switch. With these features, the player can concentrate on improvisation without having to pay attention to a number of repetitions of an accompaniment part of the musical performance during played the improvisation.

Also, an automatic playing device according to this invention is characterized in that, for the same purpose as that described above, said device is equipped with a memory to store sequence data comprising musical sound data and control data used to control said musical sound data. A counter counts a number of times to repeatedly read out musical sound data specified by control data included in sequence data stored in the memory. A processing unit generates sound by repeatedly reading out said musical sound data until a count value counted by this counter is equal to a specified value. An add instruction switch gives an instruction on addition of a number of repetitions of a part to be played, and a control device changes a count by the aforesaid counter when addition is instructed by the add instruction switch. According to this invention, for instance automatic accompaniment is performed by sequentially reading out sequence data stored in a memory. Accompaniment to, for instance, a part to be played in improvisation arranged in the automatic accompaniment section, is performed by repeatedly reading out a section specified by the control data in said memory by a number of times previously stored in the counter. If a player wants to prolong the improvisation part according to the player's mood, the player can add an arbitrary number of repetition times by issuing an instruction with the add instruction switch to change a number of times stored in said counter. With this feature, a player can freely enjoy improvisation with an arbitrary length, which makes the musical quality of the performance accompanied by an automatic accompaniment remarkably higher.

Furthermore, an automatic playing device according to this invention is characterized in that, for the same purpose as that described above, said device is equipped with a memory to store sequence data comprising musical sound data and control data to control read out of said musical sound data. A counter counts a number of times to repeatedly read out musical sound data specified by control data included in sequence data stored in the memory. A display unit displays contents set in this counter. A processing unit generates sound by repeatedly reading out said musical sound data until a value counted by the aforesaid counter is equal to a specified value.

According to this invention, as a remaining number of times to repeatedly read out said musical sound data is displayed by a display unit, a player can recognize a remaining number of times to repeatedly play a part by checking the number, and for instance, finish playing said part, or add a number of times of repetition, which which enhances the operability of the device.

BRIEF DESCRIPTION OF THE DRAWINGS

FIGS. 2A–2F are drawings showing data format of sequence data in an embodiment of this invention;

FIG. 3 is a drawing showing a configuration of registers in an embodiment of this invention.

DETAILED DESCRIPTION OF THE INVENTION

Figure 1:
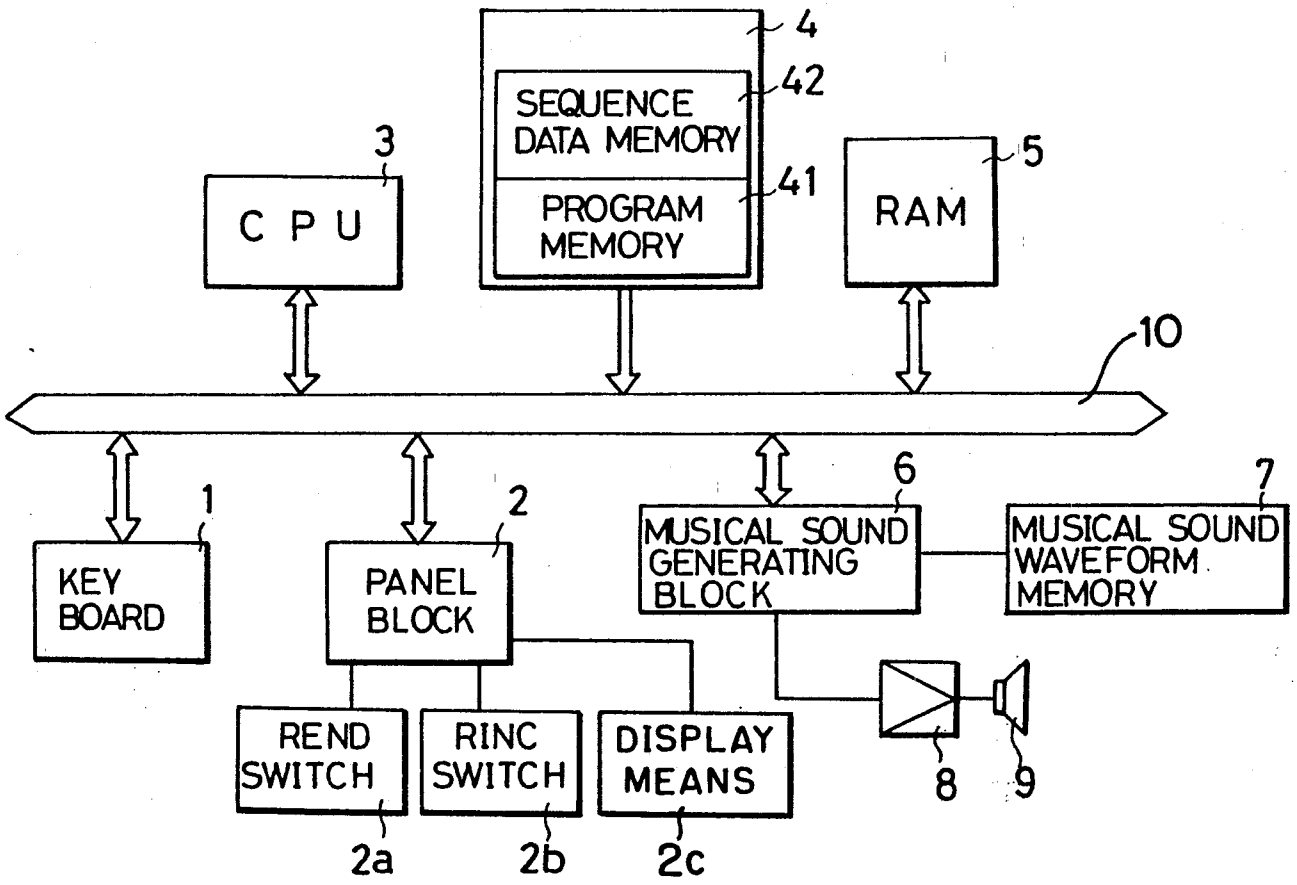
FIG. 1 is a block diagram showing a general schematic view of an automatic playing device according to this invention.

FIG. 1 is a general block diagram of key sections of an automatic playing device according to this invention.

In this drawing, 1 is a keyboard block, which includes a keyboard consisting of a plurality of keys and a key scan circuit to detect a state which each key is pressed.

2 is a panel block, which is equipped with automatic play start switch (not shown) directly related to features of this invention. In addition, various types of switches such as a power switch, a mode select switch, a memory select switch, and a rhythm select switch may be included. Also, an REND (repeat end) switch *2a* comprising foot switches and an RICN (repeat increment) switch *2b* is connected to the panel block 2.

Said REND switch *2a* and said RICN switch are not necessarily made up of foot switches, and these switches may be arranged as ordinary push switches on the panel block 2. Functions of the REND switch *2a* and the RICN switch *2b* are described hereafter. The state of each switch on the panel block 2 is, like the state of each switch in the block 1, detected by a panel scan circuit arranged inside. Furthermore, a displayer is arranged as a display means *2c* in the panel block 2, and a current value of the repeat number described hereafter is displayed.

3 is a central processing unit, which controls each block of said automatic playing device according to a control program stored in a program memory block 41 of a ROM 4.

The ROM 4 has, in addition to the above program memory 41, a sequence data memory block 42. Sequence data consisting of musical sound data which is code information to be output for accompaniment and control data used for control over said musical sound data read-out is stored in said sequence data memory block 42. Data structure of the sequence data is described later.

5 is a random access memory ("RAM"), and write/-read-out is performed under control by the CPU 3. In the RAM 5, various types of area such as a data area to which data stored in the ROM 4, such as sequence data, is transferred and stored therein. Also in RAM 5 is a working area arranged in correspondence to each key and each switch in the keyboard block 1 and the panel block 2. The working area comprises a plurality of registers in which data necessary for sound generation is set according to a state of each key or each switch are defined.

6 is a musical sound generating block, which generates an analog musical sound signal. This musical sound generating block 6 is not shown in detail, but has a memory, a musical sound signal generating circuit, a D/A converter and other components. Said memory receives and stores musical sound data for musical sound to be generated from the RAM 5. Said musical sound signal generating circuit reads out waveform data from a musical sound waveform memory 7 depending on the musical sound data stored in said memory and restores a digital musical signal from the waveform data. Said D/A converter converts the digital musical sound signal generated by the musical sound signal generating circuit to an analog musical sound signal corresponding to said digital musical sound signal.

The musical sound waveform memory 7 is a read only memory which stores waveform data and envelop data. This musical sound waveform memory 7 provides output of waveform data and envelop data according to musical sound data stored in a memory of the musical sound generating block 6.

The waveform data stored in said musical sound waveform memory 7 is read out at a speed corresponding to a key code for musical sound data stored in a memory of the musical sound generating block 6.

The analog musical sound signal, which is output from the D/A converter of this musical sound generating block 6, is output as musical sound by a sound system comprising a amplifier 8, a speaker, or a headphone 9.

Note that said keyboard block 1, said panel 2, said CPU 3, said ROM 4, said RAM 5, and said musical sound generating block 6 are connected to each other by a system bus 10.

FIG. 2A through FIG. 2F are drawings showing data format of sequence data, which is generally classified as musical sound data for musical sound to be generated and control data used for read-out control.

Key data and tone data are defined as musical sound data. Bar data, repeat start data, repeat end data, and complete end data are defined as control data.

The key data shown in FIG. 2A consists of 4 bytes, to each of which key code, step time, velocity, and gate time are specified. The key code herein is code corresponding to each key in the keyboard block 1, and shows a pitch. The step time indicates a time length from key ON note data by 1 ahead or change of tone data to key ON of said note data. The velocity is data showing a operating speed or operating strength of operational keys on the keyboard. Also, the gate time shows a time length from key ON to key OFF.

The tone data shown in FIG. 2B consists of 2 bytes, to each of which tone code and step time are specified. The tone code is data determined according to velocity data and a tone number. The step time is the same as the step time in key data in FIG. 2A.

Bar data shown in FIG. 2C consists of 2 bytes, and the first byte is all "1" data, while upper 2 bits of the second byte is "00". This bar data indicates a punctuation for a paragraph.

The repeat start data shown in FIG. 2D consists of 2 bytes, and the first byte is all "1" data, while upper 2 bits of the second byte is "01". In the lower 6 bits of the second byte is specified a repeat number indicating a number of repetition. This repeat start data specifies a start point for repeated read out and a number of repetitions.

The repeat end data shown in FIG. 2E consists of 2 bytes, and the first byte is all "1" data, while upper 2 bits of the second bytes are "10". This repeat end data indicates an end of repeated read out.

The complete end data shown in FIG. 2F consists of 2 bytes, and both the first bytes and the second byte are all "1" data. The complete end data indicates an end of automatic performance.

FIG. 3 shows, of registers arranged in the RAM 5, only those related to characteristics of this invention.

Namely, an RSA (repeat start address) register is a register which stores a repeat start address. This repeat start address is an address of the ROM 4 or RAM 5 in which sequence data is stored.

An RN (repeat number) register is a register to store a repeat number, namely a number of repetitions. An initial value of the repeat number is the same as that stored in the second byte of repeat start data included in the sequence data.

A PA (play address) register is a register which stores an address now being read out a current sequence play.

A BN (bar number register) register is a register to store a current bar number, and is incremented every time bar data appears in the sequence data.

Figure 4A:
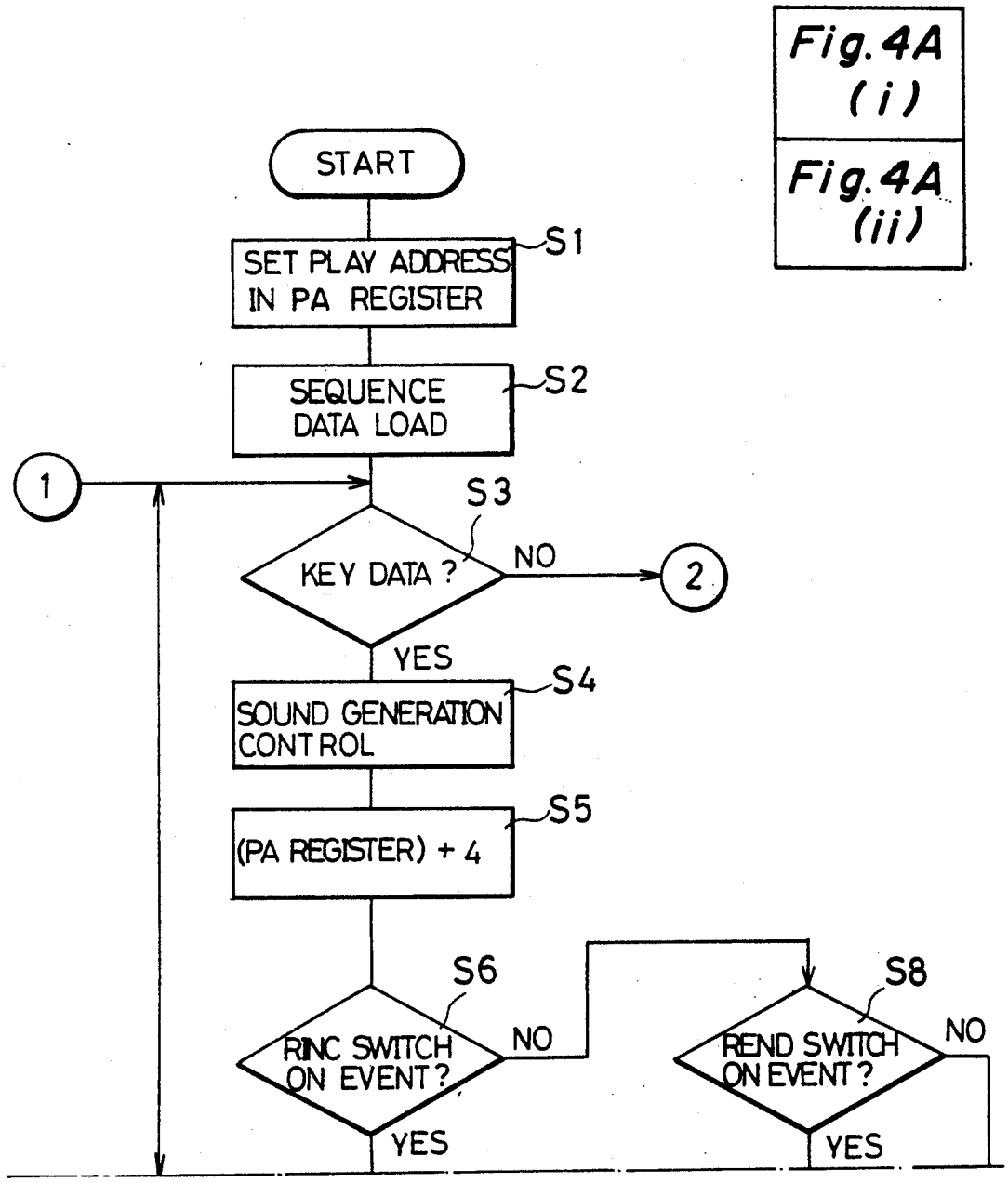
FIGS. 4A(i)–4B(ii) are flow charts to explain operations of an embodiment of this invention.
Figure 4B:
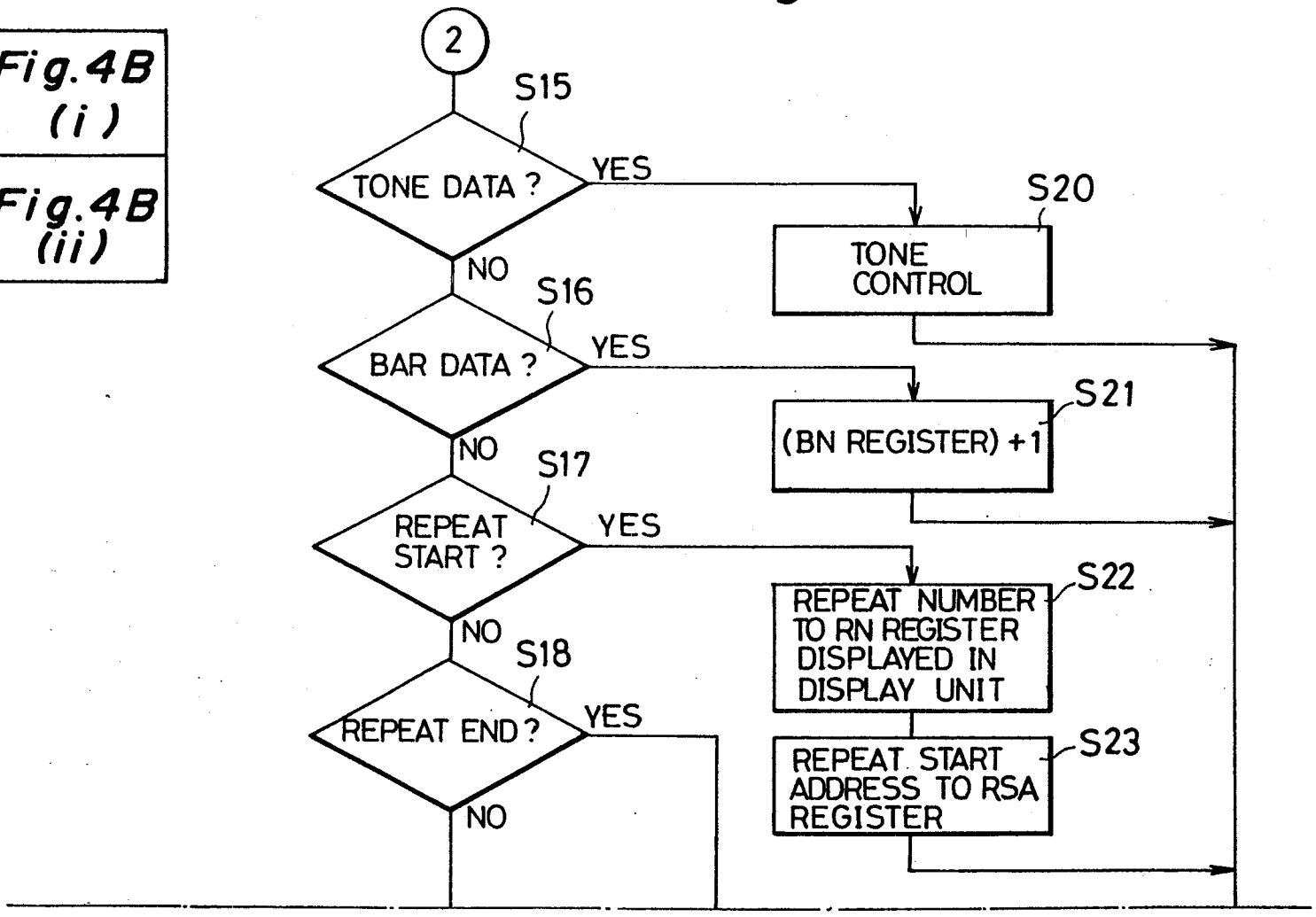

Detailed description is hereunder made for operations of this automatic playing device referring to flow charts shown in FIG. 4A and FIG. 4B assuming the above data configuration and data format.

When an automatic play start switch (not shown) arranged in the panel block 2 is depressed, the CPU 3 starts processing for automatic play according to a control program stored in the program memory 41 of the ROM 4.

At first, a play address, namely a head address of the ROM 4 or RAM 5 in which sequence data is stored is set in the PA register (Step S1).

Then, sequence data is loaded from an area specified by said address (Step S2). In this process, 4 byte are loaded if the sequence data is key data, and otherwise 2 bytes are loaded.

Then, whether the loaded data is key data or not is checked (Step S3). If it is determined that the loaded data is key data, controls over sound generation are provided according to key code, step time, velocity, and gate time included said key data (step S4). With this function, accompanying sound is released.

Then, the play address is updated by adding "4" to a value stored in the PA register (step S5), thereby reading out a next sequence data.

Then, whether an ON event of an RINC switch 2*b* of the panel block 2 occurred or not is checked (step S6), and if it is determined that an ON event occurred, the contents of the RN register is incremented, and then the contents of the RN register is displayed on a display unit in the panel block 2 (step S7). With this 1 is added to the number of times of repetitive plays previously set in the RN register. Also, a player can recognize a remaining number of times of repetitive plays by checking the display unit.

On the other hand, if it is determined that an ON event of the RINC switch 2*b* did not occur in the above step S6, whether an ON event of an REND switch 2*a* occurred or not is checked (step S8). And, if it is determined that an ON event occurred, "1" is set in the RN register, and then the contents of the RN register is displayed on the display unit in the panel block 2 (step S9). With this, even if the times of repetitive plays set in the RN register still remain, or even if an infinitely repetitive play has been specified (by specifying all "1"), the repetitive play is terminated by performing a play once more. Note that, if it is determined that an ON event of the REND switch 2*a* did not occur in the above step S8, system operation goes to step 10 without changing the contents of the RN register.

In step S10, key scan is executed, and whether an ON event of a key in a keyboard block 1 occurred or not is checked (step S11). If it is determined that an ON event occurred, sound generation allocation is performed, and sound is released (step S12). The sound generation allocation herein is defined as a process to determine which of a plurality of sound generating channels incorporated in said automatic playing device should be used to generate sound.

On the other hand, if it is determined that an ON event did not occur in the above step S11, whether an OFF event occurred or not is checked (step S13). If it is determined that an OFF event occurred, a sound generating channel corresponding to a key which was turned OFF is turned OFF (step S14). If it is determined that an ON event did not occur, sound generating channel allocation or a key-OFF processing is not performed, and system operation returns to the step S3.

With this, sound generation or sound deletion corresponding to a key on the keyboard 1 operated simultaneously with automatic accompaniment released by the above-described sound generation control (step S4) is performed, which means a play with accompaniment.

If it is determined that the sequence data in the above-described step S3 is not key data, whether it is tone data or not is checked (step S15). And, if it is determined that the sequence data is tone data, tone control is provided according to tone code and step time included in said tone data (step S20). With this, the tone of accompaniment sound is changed.

Then, the play address is updated by adding "2" to contents of the PA register to prepare for reading a next sequence data (step S28), system operation returns to the step S3, and a similar processing is repeated again.

On the other hand, if it is determined that the sequence data is not tone data in the step S15, whether the data is a bar data or not is checked (step S16). If it is determined that the data is bar data, contents of a BN register is incremented (step S21). Then, system operation branches to step S28, wherein the same processing as that described above is performed. A player can identify a bar now being played by checking contents of the BN register.

If it is determined that the data is not bar data in the above step S16, whether the data is repeat start data or not is checked (step S17). And, if it is determined that the data is repeat start data, a repeat start number in a second byte of the repeat start data is set in the RN register, and contents of the RN register is displayed on the display unit in the panel block 2 (step S22). Herein, if the repeat number is all "1", it means infinite repetition. Then, a repeat start address is set in an RSA register (step S23), and then system operation branches to step S28, wherein a similar processing like the above one is performed. From this whether repetition is required or not is checked by referring to the contents to the RN register.

If it is determined that the data is not repeat start data in the above step S17, whether the data is repeat end data or not is checked (step S18). If it is determined that the data is repeat end data, whether the repeat number specifies infinite times of repetition or not, or in other words whether the contents of the RN register is all "1" or not, is checked (step S24). If it is determined that the data does not specify infinite repetition, contents the of the RN register is decremented, and then contents of the RN register is displayed on the display unit in the panel block 2 (step S25). Then, whether the contents of the RB register is zero or not is checked (step S26), and if it is not zero, a value stored in the RSA register is entered into the PA register (step S27). With this, next the sequence data is read out from the repeat start address again, so that repeated play is realized. On the other hand, if the contents of the RN register is zero, system operation branches to the step S28, and the next sequence data is read out from a position next to the repeat end data, and system operation goes out of the repetition loop.

If it is determined in the above step S18 that the data is not repeat end data, whether the data is complete end data or not is checked (step S19). If it is determined that the data is complete end data, the series of play is finished.

On the other hand, if it is determined that the data is not complete end data, system operation branches to an error processing routine (not shown), and, for instance, a fact that an error occurred is alerted to a player by the display unit in the panel 2.

As described above, automatic accompaniment is executed by sequentially reading out sequence data stored in the ROM 4 or RAM 5, and accompaniment to, for instance, improvisation which appears during this automatic accompaniment is realized by sequentially reading out a portion (specified section) of the sequence data stored in the ROM 4 or RAM 5. A player can change an accompanying part by reading out a next sequence data by giving an instruction for termination of a playing part with the REND switch 2*a* when the player wants to go out of an improvisation part. Thus, the player can concentrate on improvisation without being aware of times of the number of repetition of an improvisation part.

Also, automatic accompaniment is executed by sequentially reading out sequence data stored in the ROM 4 or RAM 5, and accompaniment to, for instance, an improvisation part which appears during this automatic accompaniment, is executed by repeatedly reading out sequence data stored in a portion of said ROM 4 or RAM 5 by the number of times stored in the RN register when a player wishes to prolong the improvisation part according to the player's mood, the player can increase the number of times stored in said RN register by giving an instruction with the RINC switch, which enables the player to add to the number of times of repetition arbitrarily. Thus, the player can freely and flexibly enjoy improvisation with an arbitrary length, which insures a remarkably high musical performance with automatic accompaniment.

Furthermore, as the remaining number of times of repetition stored in the RN register is displayed on the display unit in the panel block 2, a player can recognize the remaining number of times of repetition for a part being played by checking the display, and, for instance, finish said playing part or increase the times of repetition arbitrarily, resulting in better musical performance.

Not that although descriptions of the aforesaid embodiment are made on the assumption that the sequence data is stored in the ROM 4, the sequence data may be stored in the RAM 5. In this case, as contents of the RAM 5, namely sequence data, can be changed, a player can remember the player's favorite playing patterns for higher freedom in automatic play.

As described above in detail, this invention eliminates the necessity for a player to remember the number times of repetition of parts for improvisational play. The invention provides an automatic playing device which enables the player to concentrate on playing with excellent operability and insures remarkably higher musical performance with automatic accompaniment.

We claim:

1. An automatic playing device for automatic accompaniment comprising: storing means for storing sequence data consisting of musical sound data and control data to control an operation to read out said musical sound data, counting means for counting a number of times of repeatedly reading out musical sound data specified by the control data, processing means for processing said musical sound data and said control data to generate sound by repeatedly reading out said musical sound data until a value counted by said counting means becomes equal to a specified value, instructing means for selectively instructing addition of a number of times to repeat an accompaniment part to be played so as to selectively alter automatic accompaniment during a musical performance, and controlling means for controlling the counting means to change a value counted when an addition of the number of times to repeat an accompaniment part is instructed by said instructing means.

2. An automatic playing device according to claim 1, wherein said storing means includes one of a read-only memory and a random access memory.

3. An automatic playing device according to claim 1, wherein said counting means includes a random access memory, and a CPU for incrementing or decrementing a value stored in the random access memory to effect said counting.

4. An automatic playing device according to claim 1, wherein said processing means includes a CPU and a musical sound generating block, wherein said CPU controls reading out sequence data from said storing means, and wherein said processing means generates musical sound by repeatedly reading out and providing the musical sound generating block with the musical sound data in a range specified by the control data included in the sequence data until a value counted by said counting means becomes equal to a specified value.

5. An automatic playing device according to claim 1, wherein said instructing means includes a foot switch.

6. An automatic playing device according to claim 1, wherein said controlling means includes a CPU for recognizing an instruction from said instructing means and changing a counted value set in said counting means in response thereto.

7. An automatic playing device comprising: storing means for storing sequence data consisting of musical sound data and control data for control of read-out of said musical sound data, counting means for counting the number of times to repeatedly read out musical sound data specified by the control data, display means for displaying contents set in said counting means, and processing means for processing said musical sound data to generate sound by repeatedly reading out said musical sound data until a value counted by said counting means becomes equal to a specified value.

8. An automatic playing device according to claim 7, wherein said storing means includes one of a read only memory and a random access memory.

9. An automatic playing device according to claim 7, wherein said counting means includes a random access memory and a CPU for incrementing or decrementing a value stored in the random access memory to effect said counting.

10. An automatic playing device according to claim 7, wherein said processing means includes a CPU and a musical sound generating block, reads out sequence data from said means for storage under control of said CPU, and generates musical sound by repeatedly reading out and providing the musical sound generating block with the musical sound data in a range specified by control data included in the sequence data until a value counted by said counting means becomes equal to a specified value.

* * * * *